US006874995B2

(12) United States Patent
Iizuka et al.

(10) Patent No.: US 6,874,995 B2
(45) Date of Patent: Apr. 5, 2005

(54) COMPRESSORS HAVING CYLINDER LINERS EXTENDING BEYOND THE CYLINDER BORES

(75) Inventors: Jiro Iizuka, Takasaki (JP); Kiyokazu Yamamoto, Isesaki (JP)

(73) Assignee: Sanden Corporation, Gunma (JP)

( * ) Notice: Subject to any disclaimer, the term of this patent is extended or adjusted under 35 U.S.C. 154(b) by 40 days.

(21) Appl. No.: 10/369,200

(22) Filed: Feb. 20, 2003

(65) Prior Publication Data

US 2003/0175129 A1 Sep. 18, 2003

(30) Foreign Application Priority Data

Feb. 21, 2002 (JP) ..... 2002-045373

(51) Int. Cl.[7] ..... F04B 27/08

(52) U.S. Cl. ..... 417/269; 92/169.1; 92/171.1; 92/71; 91/499; 91/501

(58) Field of Search ..... 417/269, 203, 417/169.1, 171.1; 92/71, 171.1; 91/499–507

(56) References Cited

U.S. PATENT DOCUMENTS 2,040,707 A * 5/1936 Palmer ..... 137/565.27
3,896,778 A * 7/1975 Zeyns et al. ..... 123/452
4,516,913 A * 5/1985 Girodin ..... 417/243
5,022,310 A * 6/1991 Stewart et al. ..... 91/501
5,058,485 A * 10/1991 Cardillo ..... 91/485
5,069,317 A * 12/1991 Stoll et al. ..... 188/286
5,360,333 A * 11/1994 Schmidt ..... 425/549
6,142,060 A * 11/2000 Saito et al. ..... 92/71
6,293,764 B1 * 9/2001 Baumann ..... 417/273
6,672,199 B2 * 1/2004 Schwarzkopf ..... 92/71

* cited by examiner

*Primary Examiner*—Cheryl J. Tyler
*Assistant Examiner*—Emmanuel Sayoc
(74) *Attorney, Agent, or Firm*—Baker Botts L.L.P.

(57) ABSTRACT

A swash type compressor includes sleeves which are fixedly fitted in cylinder bores. The lengths of the sleeves in an axial direction are greater than the lengths of the cylinder bores in the axial direction. A sleeve end of each of the sleeves is flush with an end surface of a cylinder block defining the cylinder bores. The opposite sleeve end of the sleeve extends beyond the cylinder bore and away from the opposite end surface of the cylinder block.

18 Claims, 7 Drawing Sheets

COMPRESSORS HAVING CYLINDER LINERS EXTENDING BEYOND THE CYLINDER BORES

BACKGROUND OF THE INVENTION

1. Field of the Invention

The present invention relates to a compressor which comprises a cylinder block provided with a plurality of cylinder bores, a plurality of sleeves or liners fixedly fitted in and extending beyond corresponding cylinder bores, and a plurality of pistons reciprocating between a top dead center and a bottom dead center within the sleeves.

2. Description of Related Art

In compressors, when a piston reciprocates in a sleeve in an axial direction, the piston may incline slightly in reaction to the force of a compressed fluid. Such inclination of the piston tends to occur more frequently in a compressor having a swash plate. Such inclination of the piston causes unbalanced wear of the sleeve and damage to the coating of the piston.

In Japanese Patent Application No. JP-A 2001-115955, a compressor is described which takes measures to avoid the inclination of a piston. The compressor described in that application employs a clearance fit structure of a sleeve within a cylinder bore at one or both end portions in order that the sleeve fitted in to the cylinder bore may incline in accordance with the inclination of the piston reciprocating in the sleeve. In that compressor, the cylinder bore and the sleeve have the same length in the axial direction. The cylinder bore comprises three portions: a middle portion and two end portions extending from the middle portion to the respective ends of the cylinder bore. Each of the end portions has an inner diameter that is larger than the inner diameter of the middle portion. The inner diameter of the middle portion is substantially equal to the outer diameter of the sleeve. Thus, there are slight clearances between the sleeve and the end portions of the cylinder bore facing the sleeve. In the structure disclosed in this known compressor, the sleeve also inclines when the piston inclines, so that unbalanced wear of the sleeve and damage of the coating of the piston may be reduced or avoided.

Nevertheless, the formation of the slight clearances employed in this known compressor is an exacting task in view of their dimensions and, therefore, increases manufacturing costs and complexity.

SUMMARY OF THE INVENTION

A need has arisen for an improved compressor, which does not require a clearance fit between a sleeve and a cylinder bore.

According to an embodiment of this invention, a compressor comprises a cylinder block comprising a first end surface and a second end surface opposite to each other. The cylinder block further comprises at least one cylinder bore extending from the first end surface to the second end surface and a sleeve closely fitted in each of the at least one cylinder bores and having a first sleeve end which is flush with the first end surface of the cylinder block and having a second sleeve end opposite to the first sleeve end. At least one piston is slidably fitted in the sleeve and reciprocates between a bottom dead center (D1) proximate to the first sleeve end and a top dead center (D2) opposite to the bottom dead center (D1) within the sleeve. The sleeve has a length greater than that of the cylinder bore in the axial direction and extends beyond of the cylinder bore, so that the second sleeve end is positioned distal to the second end surface of the cylinder block.

According to another embodiment of this invention, a swash plate-type compressor comprises at least one piston, wherein each piston reciprocates within a sleeve in accordance with a rotation of the swash plate. In this compressor, a housing is connected to the cylinder block to define a crank chamber adjacent to the second end surface of the cylinder block. The swash plate is rotatably disposed in the clank chamber and is coupled with each piston, and the second sleeve end extends into the crank chamber.

Further objects, features, and advantages of the present invention will be understood from the following description of preferred embodiments of the invention in connection with the accompanying drawings.

BRIEF DESCRIPTION OF THE DRAWINGS

The invention may be better understood in view of the following detailed description of preferred embodiments and the accompanying drawings.

DETAILED DESCRIPTION OF PREFERRED EMBODIMENTS

Figure 1:
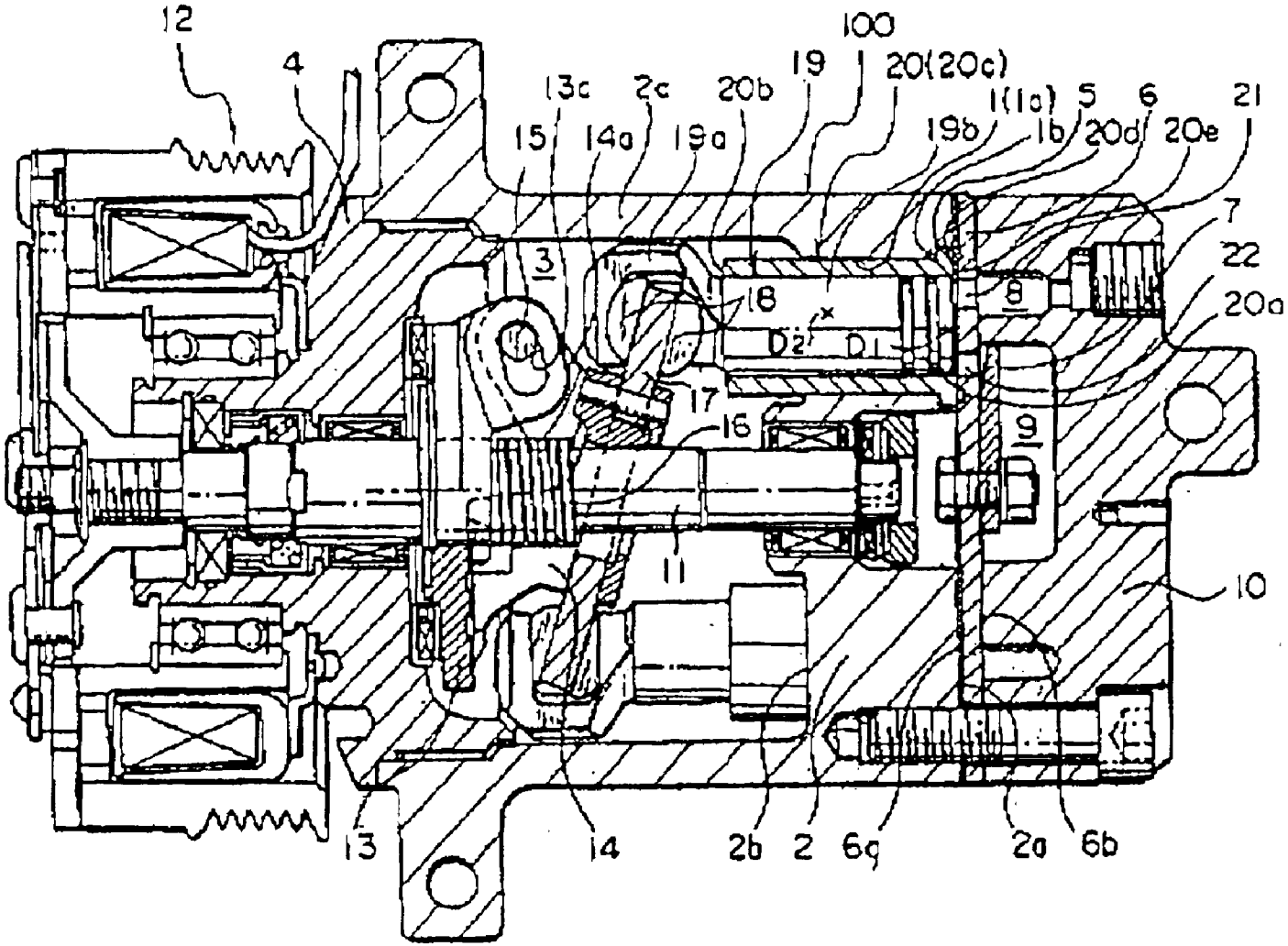
FIG. 1 is a cross-sectional view showing a compressor according to a first embodiment of the present invention.

With reference to FIGS. 1–4, a compressor 100 according to a first embodiment of the present invention is a swash-plate, variable displacement-type compressor. Compressor 100 comprises a cylinder block 2, a crank case 2*c*, an end housing 4, and a cylinder head 10, which are assembled to form a compressor housing. Cylinder block 2, crank case 2*c*, and end housing 4 define a crank chamber 4. In the embodiment shown, cylinder block 2 and crank case 2*c* are formed integrally with each other to define a single body. However, crank case 2*c* may be formed integrally with end housing 4, rather than cylinder block 2. Cylinder block 2 has a first and a second end surfaces 2*a* and 2*b* in an axial direction.

Usually, end housing 4 is referred to as a front housing. Accordingly, in the axial direction of front housing 4, a left side in FIG. 1 is referred to as a front side, while the side opposite to the front side in the axial direction, i.e., a right side in FIG. 1, is referred to as a rear side. Thus, first and second end surfaces 2*a* and 2*b* may be referred to as rear and front end surfaces 2*a* and 2*b*, respectively.

Cylinder block 2 and front housing 4 have center holes, respectively, and together support a drive shaft 11 by means of radial bearings fitted within the respective center holes, so that drive shaft 11 may rotate. Drive shaft 11 extends in the axial direction. In particular, one end of drive shaft 11 penetrates front housing 4 and extends toward the outside of front housing 4 in the axial direction. An electromagnetic clutch 12 is connected to drive shaft 11 in order to transmit a rotation force from a driving source, e.g., an engine for vehicle, to drive shaft 11.

Cylinder block 2 also is provided with a plurality of cylinder bores 1, which extend in the axial direction between first and second end surfaces 2*a* and 2*b* of cylinder block 2 to communicate with crank chamber 3. The number of cylinder bores 1 is an odd number, for example, seven, in this embodiment. Into each of cylinder bores 1, sleeves 20 are fitted closely as liners. Each of sleeves 20 has a cylindrical shape. Sleeves 20 define cylinders for receiving pistons 19, together with a first or front valve plate surface 6*a* of a valve plate 6, which is fitted to first or rear end surface 2*a* of cylinder block 2. In detail, each of the pistons 19 comprises a shoe supporter 19*a* and a piston head 19*b*, and piston head 19*b* is inserted into corresponding sleeve 20, so that piston 19*b* may reciprocate in sleeve 20 between a bottom dead center D1 and a top dead center D2 in the axial direction.

Valve plate 6 further has a second or rear valve plate surface 6*a* and a plurality of pairs of through holes 21 and 22 between front valve plate surface 6*a* and rear valve plate surface 6*b*. Each pair of holes 21 and 22 serves as a pair of suction port 21 and a discharge port 22 and is aligned to correspond with one of the cylinders, namely, an inner space of corresponding sleeve 20. In particular, discharge port 22 communicates with the corresponding cylinder. On front valve plate surface 6*a* of valve plate 6, a plurality of suction valves 5 are fitted and positioned on respective suction ports 21 to selectively open and close suction ports 21. Each of suction valves 5 is a reed valve and is bent toward front end 2*a* of cylinder block 2 when corresponding piston 19 moves toward front end 2*a* of cylinder block 2. On rear valve plate surface 6*b* of valve plate 6, a plurality of discharge valves 7 are fitted and positioned on respective discharge ports 22 to selectively open and close discharge ports 22. Each of discharge valves 7 also is a reed valve and is bent rearward in the axial direction, when corresponding piston 19 moves toward rear end 2*b* of cylinder block 2.

On rear valve plate surface 6*b* of valve plate 6, cylinder head or rear housing 10 is fitted. Cylinder head 10, in cooperation with the valve plate 6, defines a suction chamber 8 and a discharge chamber 9. Suction chamber 8 communicates with each of suction ports 21. Discharge chamber 9 is arranged so as to correspond to each discharge ports 22.

In crank chamber 3, a rotor 13 is mounted and fixed on drive shaft 11, so that rotor 13 rotates when drive shaft 11 rotates. Rotor 13 also is supported via a thrust bearing by front housing 4 in the axial direction. Rotor 13 has a tab portion or arm portion provided with an elongated hole 13*a*. On drive shaft 11, a supporter or boss 14 is mounted, such that rotor 13 may incline variably within a predetermined angular range with respect to an imaginary plane perpendicular to the axial direction. Boss 14 has another tab portion or arm portion 14*a* provided with a pin 15. Pin 15 of boss 14 is inserted into elongated hole 13*a* of rotor 13, and pin 15 is movable in elongated hole 13*a*. A coil spring 16 is disposed on drive shaft 11 between rotor 13 and boss 14. On boss 14, a swash plate 17 is fixed. Thus, swash plate 17 is supported by boss 14, such that swash plate 17 inclines variably within the predetermined angular range together with boss 14.

On a peripheral part of swash plate 17, a plurality of pairs of shoes 18 are arranged at regular intervals. The peripheral part of swash plate 17 is interposed between each pair of shoes 18 so that swash plate 17 slides between each pair of shoes 18. Each pair of shoes 18 is supported by respective shoe supporters 19*a* of pistons 19, so that each pair of shoes 18 slides on the inner surfaces of respective shoe supporters 19*a*. Thus, swash plate 17 is coupled to shoe supporters 19*a* of pistons 19 via respective pairs of shoes 18.

With the above-mentioned structure, when drive shaft 11 rotates, swash plate 17 also rotates. As swash plate 17 rotates, swash plate 17 slides between each pair of shoes 18. During such rotation, each pair of shoes 18 goes forward or rearward in accordance with the part of swash plate 17 interposed therebetween, while sliding on the inner surface of corresponding shoe supporter 19*a*. Shoe supporter 19*a* moves in the axial direction according to the movement of corresponding pair of shoes 18. Thus, piston 19 reciprocates between the bottom dead center D1 and the top dead center D2 within sleeve 20 in the axial direction. By the reciprocating motions of each piston 19, a fluid, e.g., a gas or liquid, is drawn from corresponding suction chamber 8 through corresponding suction port 21 into the corresponding cylinder, is compressed within the corresponding cylinder, and then is discharged from the corresponding cylinder through corresponding discharge port 22 to the corresponding discharge chamber 9. As shown in FIG. 1, suction valve 5 opens only during the suction of the fluid, while discharge valve 7 opens only during the discharge of the compressed fluid. The inclination of entire swash plate 17 is controlled in accordance with the internal pressure of crank chamber 3, so that the movement distances or strokes of reciprocating pistons 19 also are controlled.

Sleeve 20 is made of material, which allows piston head 19*b* to reciprocate smoothly within sleeve 20, and is resistant to influence by heat, refrigerants, and lubricants; is more flexible than that of cylinder block 2; and is suitable for the press fitting of sleeve 20 within cylinder bore 1. The material of sleeve 20 has a thermal expansion coefficient larger than that of the material of cylinder block 2. For example, if cylinder block 2 and piston 19 are made of aluminum, the material of sleeve 20 may be a resin, such as fluoroplastic or fluorocarbon resin.

Because the material of sleeve 20 has the larger thermal expansion coefficient, sleeve 20 is brought into close contact with cylinder bore 1 when compressor 100 operates and sleeve 20 is heated. There is no gap between sleeve 20 and cylinder bore 1 that allows an escape of fluid. In known compressors, if a cylinder block and a piston were made of aluminum and if there were no sleeve, the piston might be coated with a special material in order to prevent the piston from seizing up during the reciprocating motion. However, because sleeve 20 is made of material which allows piston head 19*b* to reciprocate smoothly, in sleeve 20, such a coating is not needed for piston 19. In addition, if sleeve 20 is made of the same material as a piston ring, which is employed normally in a compressor in order to prevent damage of a piston, such piston ring may be omitted from the embodiment of this invention.

In this embodiment, sleeve 20 has an axial length L1 between a first, and a second sleeve ends 20*a* and 20*b*. The axial length L1 is greater than an axial length L2 of cylinder bore 1. First or rear sleeve end 20*a* of sleeve 20 is aligned on the same plane as first or rear end surface 2*a* of cylinder block 2, namely, one end of cylinder bore 1 in the axial direction. First sleeve end 20*a* is the sleeve end closest to the bottom dead center D1 of piston 19 reciprocating in sleeve 20. Accordingly, second or front sleeve end 20*b* of sleeve 20, which is nearest the top dead center D2, extends beyond of cylinder bore 1, namely, into crank chamber 3. In other words, front sleeve end 20*b* of sleeve 20 is positioned away from second end surface 2*b* of cylinder block 2. An outer peripheral surface of a portion of sleeve 20 projects from cylinder bore 1, and therefore, faces the inner wall of crank case 2*c* or the wall of crank chamber 3 and a portion of drive shall 11 directly.

Figure 5:
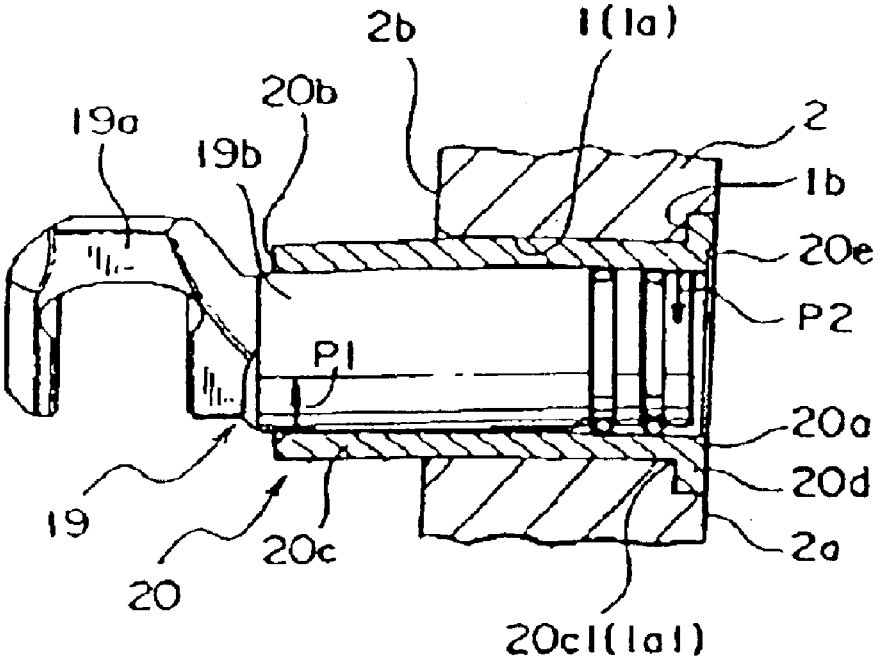
FIG. 5 is a cross-sectional view for use in describing an inclination of the piston of FIG. 2.

In compressor 100, piston 19 may incline in reaction to the force of the compressed gas, as shown in FIG. 5. For example, when piston 19 is urged towards swash plate 17 in reaction to the force of the compressed gas, corresponding pair of shoes 18 slides on swash plate 17 and moves toward the center of swash plate 17, namely, toward an intersection of swash plate 17 and drive shaft 11. At that time, shoe supporter 19*a* of piston 19 follows corresponding pair of shoes 18. As a result, piston 19 inclines. However, when piston 19 inclines, the portion of sleeve 20 projecting from cylinder bore 1 is deformed in accordance with the inclination of piston 19. This is because there is no obstacle to inclination of sleeve 20, and sleeve 20 is made of more flexible material, as described above. The deformation of sleeve 20 may reduce a contact pressure P1 between piston head 19*b* and sleeve 20 in the vicinity of front sleeve end 20*b* of sleeve 20 in contrast to the case in which a cylinder bore and a sleeve have the same length in the axial direction. Therefore, unbalanced wear of sleeve 20 may be reduced or eliminated. There is no clearance in the fit between sleeve 20 and cylinder bore 1, and therefore, an exacting task for making slight clearances is not required for the manufacture of the present embodiment. The shorter length of cylinder bore 1 reduces the weight of cylinder block 2 and consequently, compressor 100. In addition, because a contact pressure P2 between piston head 19*b* and sleeve 20 in the vicinity of rear sleeve end 20*a* of sleeve 20 is less than the contact pressure P1, excessive wear on sleeve 20 in the vicinity of rear sleeve end 20*a* is reduced or eliminated, and pistons 19 are not damaged.

Figure 2:
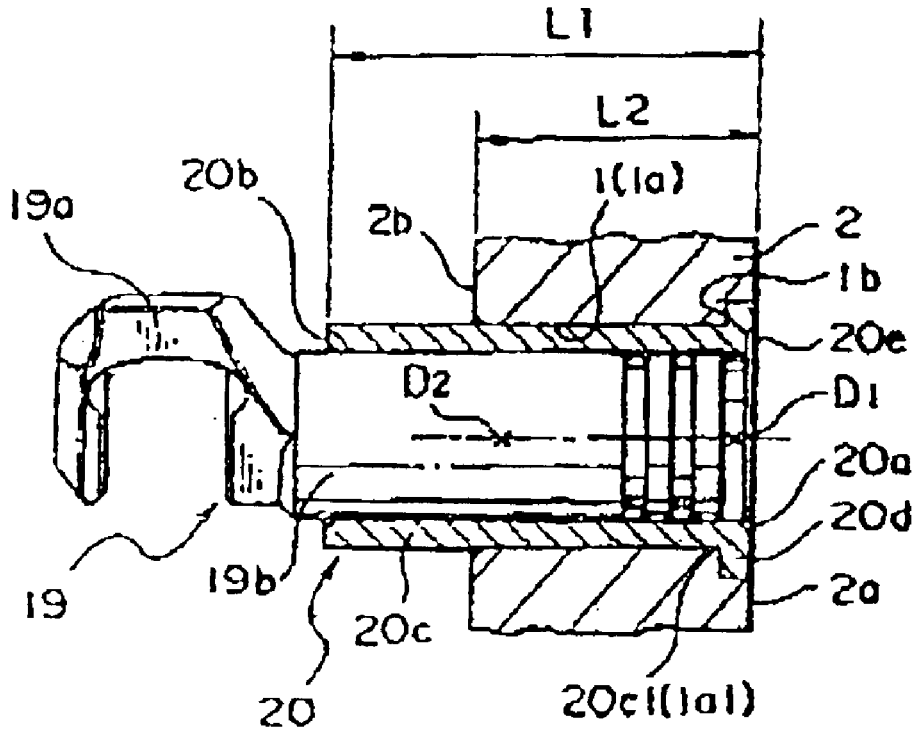
FIG. 2 is an enlarged, cross-sectional view showing a cylinder bore, a sleeve, and a piston, which are included in the compressor of FIG. 1.

Referring to FIG. 2, the length L1 of sleeve 20 in the axial direction is manufactured to be greater than the length L2 of cylinder bore 1, but not greater than two times the length L2 of cylinder bore 1. This length relationship is determined, so that cylinder bore 1 may support sleeve 20 sufficiently.

Figure 3:
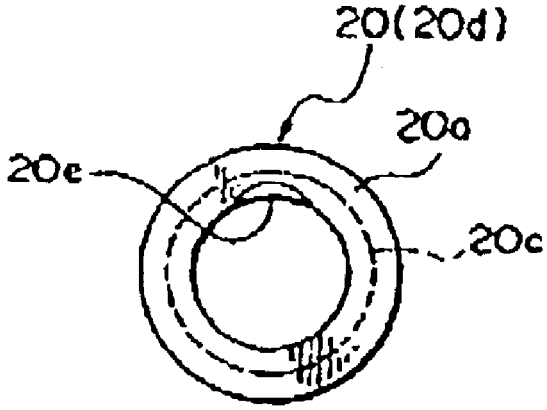
FIG. 3 is an end view of the sleeve of FIG. 2, as seen from the right side in FIG. 2.
Figure 4:
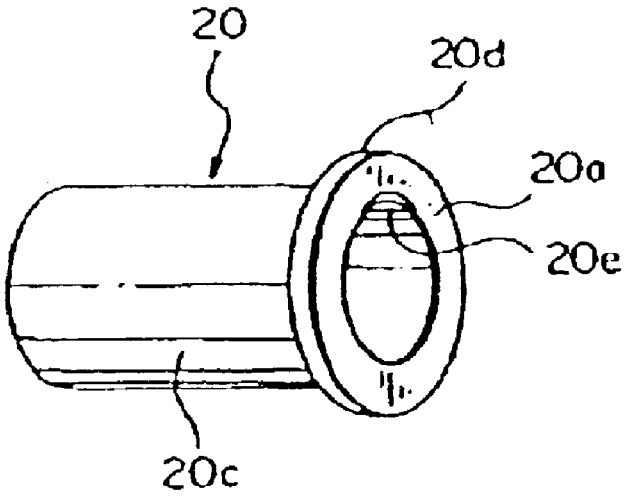
FIG. 4 is a perspective view showing the sleeve of FIG. 2.

Referring to FIGS. 2–4, cylinder bore 1 has a bore end opening in first end surface 2*a* of cylinder block 2. Cylinder block 2 is cut out at an opening edge of the bore end opening to form a cut out portion 1*b*. Sleeve 20 has a radial flange 20*d* radially extending from first sleeve end 20*a*. Radial flange 20*d* has a first flange surface providing a surface of first sleeve end 20*a* and a second flange surface opposite to the first flange surface. The second flange surface defines an outer circumferential surface of sleeve 20. Radial flange 20*d* is fitted in cut out portion 1*b*.

More specifically, sleeve 20 comprises a main portion 20*c* and radial flange 20*d*, while cylinder bore 1 comprises a main portion 1*a* and cut out portion 1*b*, as shown in FIGS. 2–4. Main portion 20*c* of sleeve 20 extends in the axial direction and has a rear end 20*c*1. Radial flange 20*d* extends from rear end 20*c*1 of main portion 20*c* of sleeve 20 to rear end surface 2*a* of cylinder block 2. A surface of flange 20*d* forms a surface of rear sleeve end 20*a* of sleeve 20. Radial flange 20*d* has a ring-plate shape, which has a predetermined thickness in the axial direction. Main portion 1*a* of cylinder bore 1 extends in the axial direction and has a rear end 1*a*1. Cut out portion 1*b* extends from rear end 1*a*1 of main portion 1*a* of cylinder bore 1 to rear end surface 2*a* of cylinder block 2.

Radial flange 20*d* has a constant thickness. Cut out portion 1*b* is an annular recess having a constant depth corresponding to the ring-plate shape of radial flange 20*d*.

The inner diameter of cut out portion 1*b* is greater than the inner diameter of main portion 1*a*. The opening shape of cut out portion 1*b* has a cross-sectional shape of a staircase of a single step. As viewed from rear end surface 2*a* of cylinder block 2, the opening shape of cut out portion 1*b* shows different levels of concentric circles in cooperation with the inner wall of main portion 1*a* of the cylinder bore 1. Radial flange 20*d* is fitted into cut out portion 1*b*, so that rear end 1a1 of main portion 1*a* of cylinder bore 1 is in contact with rear end 20*c*1 of main portion 20*c* of sleeve 20. As clearly depicted in FIG. 2, main portion 1*a* of cylinder bore 1 supports a portion of main portion 20*c* of sleeve 20 corresponding to the length of cylinder bore 1. Radial flange 20*d* prevents sleeve 20 from slipping out from cylinder bore 1.

Radial flange 20*d* has a dimension slightly larger than that of cut out portion 1*b* in the axial direction before radial flange 20*d* is fitted to cut out portion 1*b*. In other words, radial flange 20*d* has a thickness greater than the depth of cut out portion 1*b* in the axial direction. In a practical manufacturing process, radial flange 20*d* is inserted into and fitted within cut out portion 1*b*, and rear sleeve end 20*a* is pushed and compressed by valve plate 6 in the axial direction, so that rear sleeve end 20*a* of sleeve 20 is substantially flush with rear end surface 2*a* of cylinder block 2. The fitting process secures radial flange 20*d* within cut out portion 1*b*. Therefore, a fluid leak may not occur between radial flange 20*d* and cut out portion 1*b*, and a sealing member, such as a rubber gasket may be omitted.

Rear sleeve end 20*a* of sleeve 20 is formed with an indent portion 20*e*, which is radially outwardly indented in an opening edge of rear sleeve end 20*a*. Indent portion 20*e* is arranged to correspond to a portion of suction valve 5 to regulate an opening area of suction valve 5. When the fluid is drawn into the cylinder from suction chamber 8, suction valve 5 is bent toward piston head 19*b*, but its movement is restricted by the depth of indent portion 20*e*. Thus, indent portion 20*e* also serves to prevent suction valve 5 from being in contact with piston head 19*b*. Therefore, indent portion 20*e* prevents the damage to suction valve 5 and piston head 19*b*.

Figure 6:
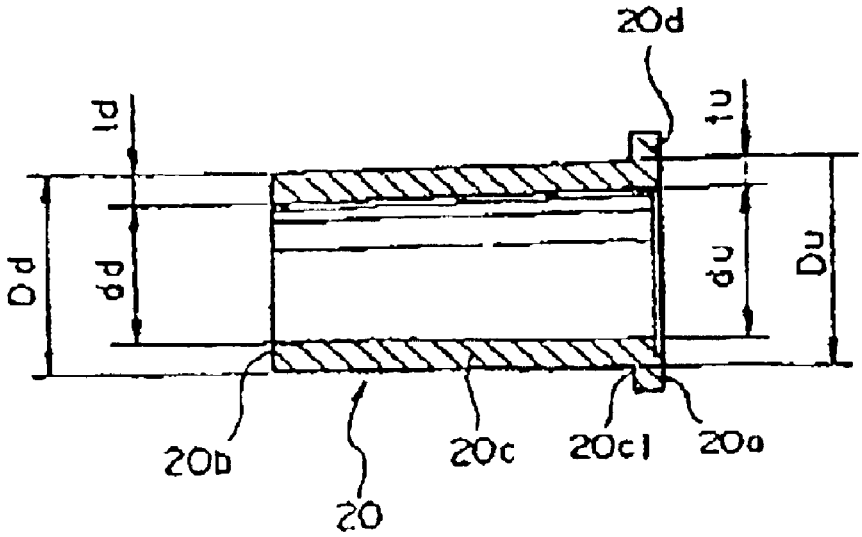
FIG. 6 is a cross-sectional view for use in describing structural conditions of the sleeve of FIG. 2.

With reference to FIG. 6, sleeve 20 meets the following structural conditions: 1) an internal diameter (du) of first or rear sleeve end 20*a* is greater than an external diameter (Dp) of piston 19; 2) an internal diameter (dd) of second or front sleeve end 20*b* is greater than the internal diameter (du) of rear sleeve end 20*a;* 3) an external diameter (Dd) of front sleeve end 20*b* is less than or equal to an external diameter (Du) of rear end 20*c*1 of main portion 20*c* of sleeve 20; and 4) a wall thickness of sleeve 20 at front sleeve end 20*b*, which is one half the difference (td) between the external and internal diameters (Dd, dd) of front sleeve end 20*b*, is less than another wall thickness of sleeve 20 at rear sleeve end 20*a*, which is one half the difference (tu) between the internal diameter (du) of rear sleeve end 20*a* and the external diameter (Du) of rear end 20*c*1 of main portion 20*c* of the sleeve 20. The first and second conditions allow that piston head 19*b* is inserted into sleeve 20 readily and smoothly. The third and fourth conditions independently make the solidity of sleeve 20 increase in a vicinity of front end of cylinder bore 1, so that the excessive deformation of the sleeve 20 is prevented.

Figure 7:
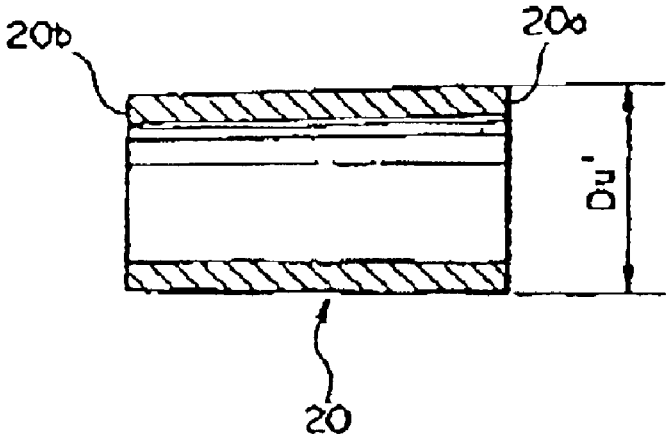
FIG. 7 is a cross-sectional view for use in describing structural conditions of a modification of the sleeve of FIG. 2.

Sleeve 20 may be modified to omit flange 20*d*. In that case, the foregoing structural conditions are modified, so that the external diameter (Du) of rear end 20*c*1 of main portion 20*c* of sleeve 20 is replaced with an external diameter (Du') of rear sleeve end 20*a* of sleeve 20, as shown in FIG. 7.

Figure 8:
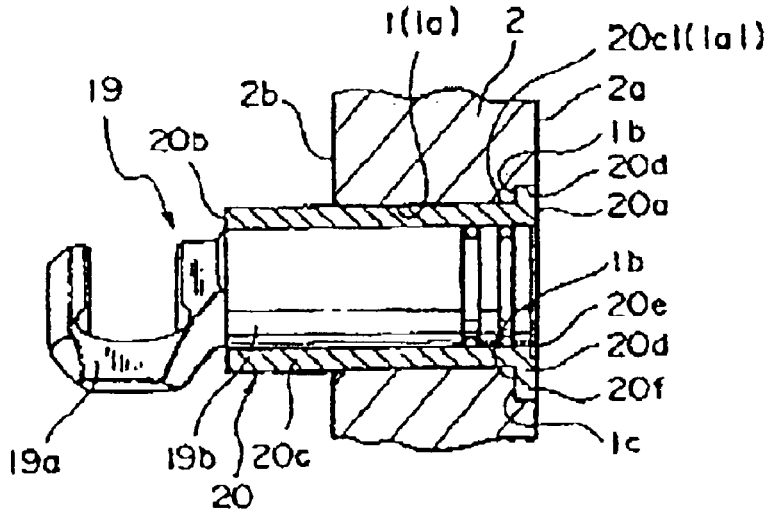
FIG. 8 is a cross-sectional view showing a cylinder bore, a sleeve and a piston in accordance with a second embodiment of the present invention.
Figure 9:
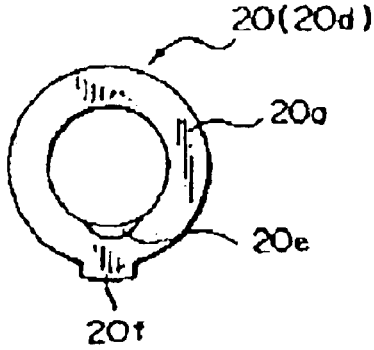
FIG. 9 is an end view of the sleeve of FIG. 8, as seen from the right side in FIG. 8.
Figure 10:
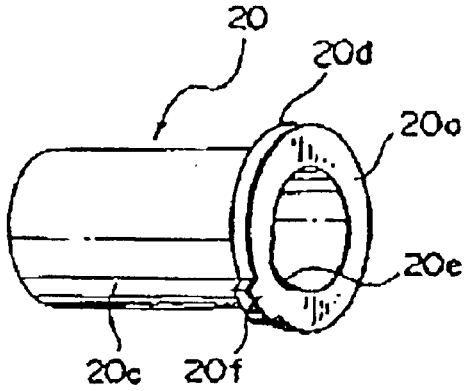
FIG. 10 is a perspective view showing the sleeve of FIG. 8.

With reference to FIGS. 8–10, a compressor according to a second embodiment of the present invention has the same structure as the first embodiment, except for sleeve 20 and cylinder bore 1. Sleeve 20 and cylinder bore 1 also have much the same structure as the first embodiment. The differences therebetween are described below.

Sleeve 20 further comprises a key 20*f* radially projecting outward therefrom, and cylinder block 20 comprises a key groove 1*c* receiving key 20*f*, so that sleeve 20 is prevented from rotating in cylinder bore 1. More specifically, sleeve 20 comprises key 20*f* at one end thereof defining rear sleeve end 20*a*. In this embodiment, key 20*f* is positioned in a line which passes through the middle of indent portion 20*e* and is perpendicular to the center axis of sleeve 20. Cylinder bore 1 is provided with key groove 1*c*, which extends from rear end surface 2*a* of cylinder block 2 and from cut out portion 1*b* of cylinder bore 1. Key 20*f* is fitted within key groove 1*c*. Key 20*f* fitted within key groove 1*c* serves to prevent sleeve 20 from rotating and sliding on the inner surface of cylinder bore 1. In addition, key 20*f* serves to position indent portion 20*e* near suction valve 5. Sleeve 20 also meets the same structural conditions as the first embodiment, which was explained with reference to FIG. 6.

Figure 11:
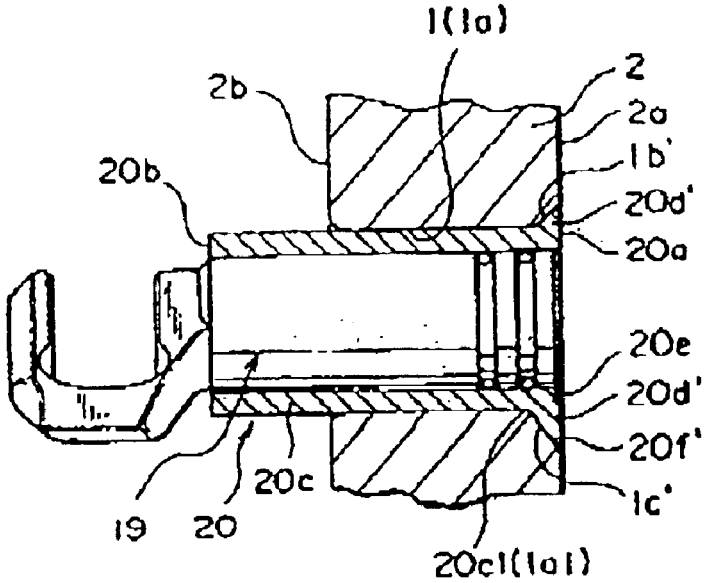
FIG. 11 is a cross-sectional view showing a cylinder bore, a sleeve, and a piston in accordance with a third embodiment of the present invention.
Figure 12:
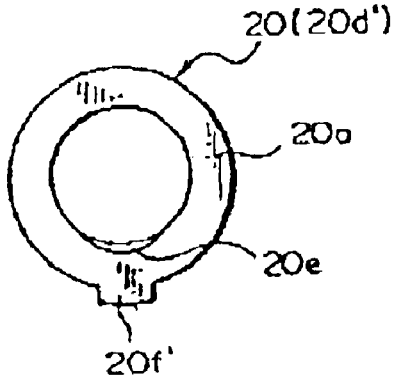
FIG. 12 is an end view of the sleeve of FIG. 11, as seen from the right side in FIG. 11.
Figure 13:
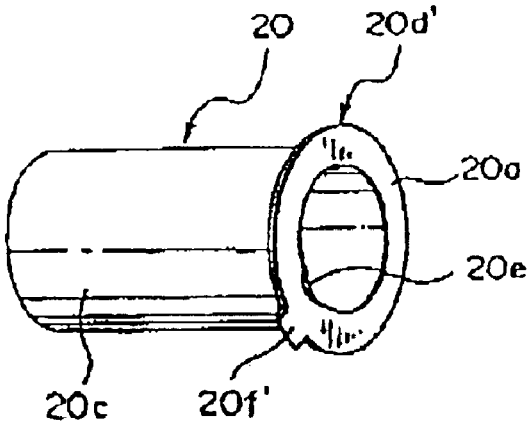
FIG. 13 is a perspective view showing the sleeve of FIG. 11.

With reference to FIGS. 11–13, a compressor according to a third embodiment of the present invention has the same structure as the first embodiment, except for sleeve 20 and cylinder bore 1. Sleeve 20 and cylinder bore 1 also have much the same structure as the first embodiment. The differences therebetween are described below.

A radial flange 20*d*' has a tapered ring-plate shape with a thickness gradually reducing outwardly in the radial direction. One surface of the ring plate provides first sleeve end 20*a* of sleeve 20 and the opposite surface of the ring plate is inclined in relation to the axial direction. In other words, radial flange 20*d*' has a particular ring shape, which has an outer wall of a partial, conical shape and an inner wall extending to the inner wall of main portion 20*c* of sleeve 20. The outer wall of this particular ring shape is tapered from rear end surface 2*a* toward main portion 20*c* of sleeve 20. A cut out portion 1*b*' has an opening shape corresponding to this particular ring shape of flange 20*d*'. The opening shape of cut out portion 1*b*' has a partial funnel shape.

Sleeve 20 is provided with a key 20*f*' in addition to flange 20*d*' and indent portion 20*e*. Key 20*f*' has substantially the same function as key 20*f* of the second embodiment, but has a different shape due to the shape of flange 20*d*'. Key 20*f*' has a triangular cross-section in a plane, which includes the center axis of sleeve 20. A key groove 1*c*' also is provided in cylinder bore 1 and performs the same function as portion 1*c* of the second embodiment, but has a different shape, which corresponds to the shape of key 20*f*. Sleeve 20 also meets the same structural conditions as the first embodiment, which explained with reference to FIG. 6.

Figure 14:
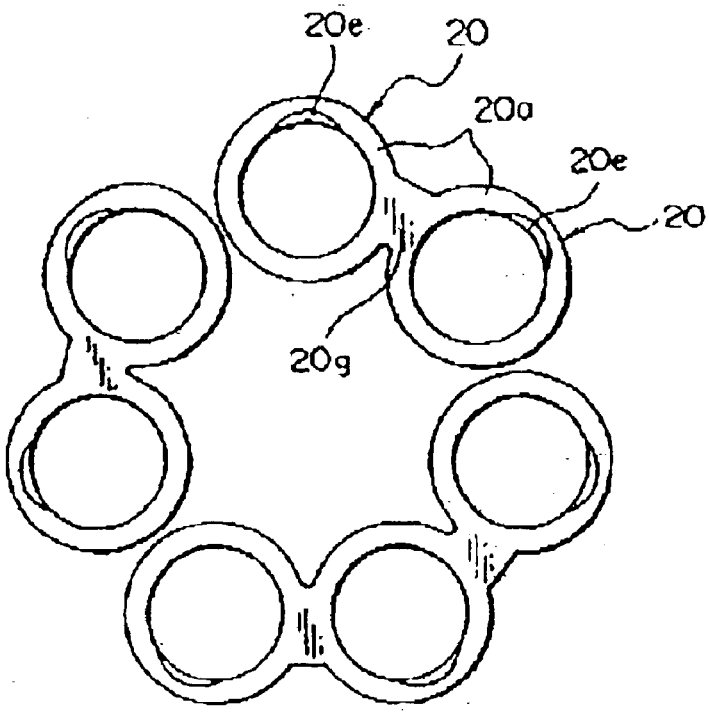
FIG. 14 is an end view of a plurality of sleeves according to fourth embodiment of the present invention.
Figure 15:
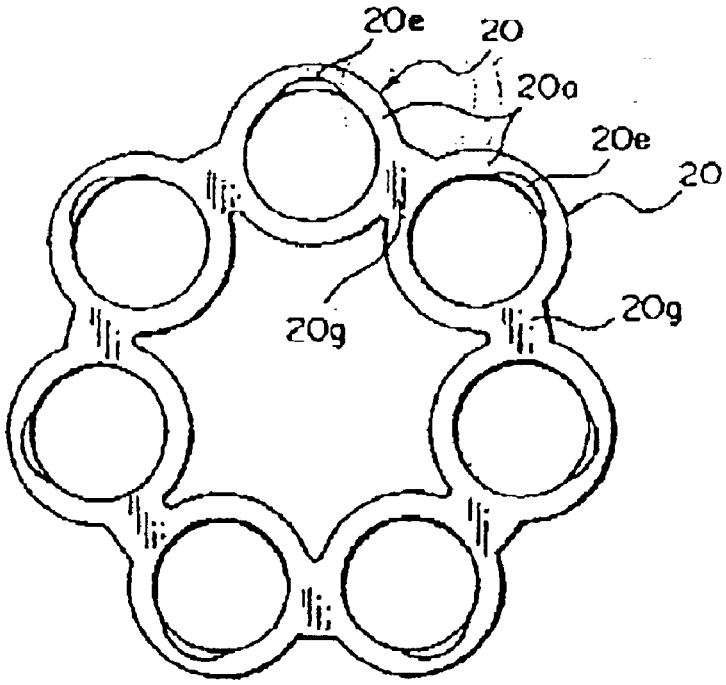
FIG. 15 is an end view of a plurality of sleeves according to fifth embodiment of the present invention.

With reference to FIGS. 14 and 15, fourth and fifth embodiments are explained below. In the fourth embodiment of the present invention, sleeves 20 are grouped into two or more groups, and, in one of the groups of sleeves 20, one of sleeves 20 is connected to another or other of sleeves 20 by means of connection portions 20*g*, as shown in FIG. 14. In the fifth embodiment of the present invention, all of sleeves 20 are connected to neighboring sleeves 20 by means of connection portions 20*g*, as shown in FIG. 15. In the fourth or the fifth embodiment, connection portions 20*g* perform substantially the same function as key 20*f* of the second embodiment or key 20*f*' of the third embodiment. Cylinder block 2 has portions for accommodating connection portions 20*g* instead of key grooves 1*c* or 1*c*' of the second or the third embodiment. In the fourth or the fifth embodiment, each sleeve 20 comprises a radial flange, such as radial flange 20*d* of the first embodiment or the flange 20*d*' of the third embodiment.

Although sleeve 20 comprises the radial flange in every embodiment, the sleeve may have no radial flange. The present invention is applicable not only to a variable displacement compressor, but also to a fixed displacement compressor. The present invention also is applicable to a compressor having a wobble plate.

Although the invention has been described in detail with respect to preferred embodiments, the foregoing description is intended to be merely exemplary of the invention. It will be apparent to those of skill in the art that variations and modifications may be applied without departing from the concept, spirit, or scope of the invention. The true spirit and scope of the invention is not intended to be limited by the foregoing description, but instead is intended to be commensurate with the scope of the claims.

What is claimed is:

1. A compressor comprising: a cylinder block comprising a first end surface and a second end surface apposite to each other, the cylinder block further comprising at least one cylinder bore extending from the first end surface to the second end surface; a sleeve closely fitted in each of said at least one cylinder bores and having a first sleeve end which is flush with the first end surface and having a second sleeve end opposite to the first sleeve end; and at least one piston slidably fitted in the sleeve, so as to reciprocate between a bottom dead center (D1) proximate to the first sleeve end and a top dead center (D2) opposite to the bottom dead center (D1) within the sleeve wherein the sleeve has a length greater than that of the cylinder bore and extends beyond the cylinder bore, so that the second sleeve end is positioned distal to the second end surface of the cylinder block; and further comprising a plurality of cylinder bores and a plurality of sleeves, wherein the a plurality of sleeves are connected with each other by means of at least one connection portion and wherein said at least one connection portion extends between two of said plurality of sleeves, such that said at least one connection portion prevents said two sleeves from rotating and sliding on inner surfaces of said cylinder bores.

2. The compressor according to claim 1, wherein the length of the sleeve is less than or equal to two times the length of the cylinder bore.

3. The compressor according to claim 1, wherein the cylinder bore has a bore end opening in the first end surface of the cylinder block, and the cylinder block comprises a cut out portion formed at an edge of an end opening of each cylinder bore, and wherein the sleeve comprises a radial flange extending radially from the first sleeve end, the radial flange comprising a first flange surface forming an end surface of the first sleeve end and a second flange surface opposite to the first flange surface wherein the second flange surface forms an outer circumferential surface of the sleeve and the radial flange is contained fittingly within the cut out portion.

4. The compressor according to claim 3, wherein the radial flange has a dimension slightly greater than the depth of the cut out portion before the radial flange is fitted into the cut out portion and wherein the radial flange is fitted into the cut out portion, and the radial flange is pressed into and compressed in the cut out portion, so that the first flange surface of the radial flange is substantially flush with the first end surface of the cylinder block.

5. The compressor according to claim 3, wherein the radial flange has a ring-plate shape, which has a predetermined thickness in the axial direction; and the cut out portion has an annular opening corresponding to the ring-plate shape of the flange.

6. The compressor according to claim 5, wherein the predetermined thickness is constant in the radial direction, while the cut out portion is an annular recess having a depth in the axial direction.

7. A compressor comprising: a cylinder block comprising a first end surface and a second end surface opposite to each other, the cylinder block further comprising at least one cylinder bore extending from the first end surface to the second end surface; a sleeve closely fitted in each of said at least one cylinder bores and having a first sleeve end which is flush with the first end surface and having a second sleeve end opposite to the first sleeve end; and at least one piston slidably fitted in the sleeve, so as to reciprocate between a bottom dead center (D1) proximate to the first sleeve end and a top dead center (D2) opposite to the bottom dead center (D1) within the sleeve wherein the sleeve has a length greater than that of the cylinder bore and extends beyond the cylinder bore, so that the second sleeve end is positioned distal to the second end surface of the cylinder block; wherein the radial flange has a ring-plate shape, which has a predetermined thickness in the axial direction; and the cut out portion has an annular opening corresponding to the ring-plate shape of the flange and wherein the radial flange having the ring-plate shape is tapered and has a thickness gradually decreasing in the radial direction with the second flange surface being inclined in relation to the axial direction; and the cut out portion has a funnel-shape corresponding to the radially-tapered form of the radial flange.

8. The compressor according to claim 1, wherein the sleeve is made of a material which has a thermal expansion coefficient greater than that of the cylinder block.

9. A compressor comprising: a cylinder block comprising a first end surface and a second end surface opposite to each other, the cylinder block further comprising at least one cylinder bore extending from the first end surface to the second end surface; a sleeve closely fitted in each of said at least one cylinder bores and having a first sleeve end which is flush with the first end surface and having a second sleeve end opposite to the first sleeve end; and at least one piston slidably fitted in the sleeve, so as to reciprocate between a bottom dead center (D1) proximate to the first sleeve end and a top dead center (D2) opposite to the bottom dead center (D1) within the sleeve wherein the sleeve has a length greater than that of the cylinder bore and extends beyond the cylinder bore, so that the second sleeve end is positioned distal to the second end surface of the cylinder block; wherein the sleeve has a tubular shape and an internal diameter (du) of the first sleeve end is greater than an external diameter (Dp) of the piston; an internal diameter (dd) of the second sleeve end is greater than the internal diameter (du) of the first sleeve end; an external diameter (Dd) of the second sleeve end is less than or equal to an external diameter (Du') of the first sleeve end; and a wall thickness (td) of the sleeve at the second sleeve end, which is one half the difference between the external and internal diameters (Dd,dd) of the second sleeve end, is less than another wall thickness (tu) of the sleeve at the first sleeve end, which is one half the difference (tu) between the internal diameter (du) of tile first sleeve end and the external diameter (Du') of the first sleeve end.

10. A compressor comprising: a cylinder block comprising a first end surface and a second end surface opposite to each other, the cylinder block further comprising at least one cylinder bore extending from the first end surface to the second end surface; a sleeve closely fitted in each of said at least one cylinder bores and having a first sleeve end which is flush with the first end surface and having a second sleeve end opposite to the first sleeve end; and at least one piston slidably fitted in the sleeve, so as to reciprocate between a bottom dead center (D1) proximate to the first sleeve end and a top dead center (D2) opposite to the bottom dead center (D1) within the sleeve wherein the sleeve has a length greater than that of the cylinder bore and extends beyond the cylinder bore, so that the second sleeve end is positioned distal to the second end surface of the cylinder block; further comprising a valve plate, a suction valve and a discharge valve, wherein the valve plate has a first valve plate surface and a second valve plate surface and is formed with at least one pair of suction and discharge ports extending between the first and second valve plate surfaces; the valve plate is fixedly mounted on the first end surface of the cylinder block with the first valve plate surface facing the first end surface of the cylinder block, so that the pair of the suction and the discharge ports of the valve plate are aligned with an interior of the sleeve; the suction valve is fixedly mounted on the first valve plate surface of the valve plate so as to be selectively open and dose the suction port; the discharge valve is fixedly mounted on the second valve plate surface of the valve plate so as to selectively open and dose the discharge port; the sleeve has a radially-outward indent portion partially formed at an opening edge at the first sleeve end thereof, the indent portion corresponding to a portion of the suction valve to regulate an opening area of the suction valve.

11. The compressor according to claim 1, wherein the sleeve has a radially-outward projecting key, and the cylinder block has a key groove receiving the key to prevent the sleeve from rotating in the cylinder bore.

12. The compressor according to claim 3, wherein the sleeve has a key, radially outward projecting from the radial flange and the cylinder block has a key groove extending continuously from the cut out portion for receiving the key.

13. The compressor according to claim 1, comprising a swash plate, wherein the piston reciprocates in the sleeve in accordance with a rotation of the swash plate.

14. The compressor according to claim 13, which further comprises a housing connected to the cylinder block to define a crank chamber adjacent the second end surface of the cylinder block, wherein the swash plate is rotatably disposed in the crank chamber and coupled with the piston and wherein the second sleeve end is in the crank chamber.

15. The compressor according to claim 7, further comprising a plurality of cylinder bores and a plurality of sleeves, wherein the a plurality of sleeves are connected with each other by means of at least one connection portion.

16. The compressor according to claim 8, further comprising a plurality of cylinder bores and a plurality of sleeves, wherein the a plurality of sleeves are connected with each other by means of at least one connection portion.

17. The compressor according to claim 9, further comprising a plurality of cylinder bores and a plurality of sleeves, wherein the a plurality of sleeves are connected with each other by means of at least one connection portion.

18. The compressor according to claim 10, further comprising a plurality of cylinder bores and a plurality of sleeves, wherein the a plurality of sleeves are connected with each other by means of at least one connection portion.

* * * * *